United States Patent [19]

Freychet et al.

[11] Patent Number: 4,848,446

[45] Date of Patent: Jul. 18, 1989

[54] DEVICE FOR MAINTAINING IN POSITION ONE END OF AN ELEMENT MOUNTED FOR ROTATIONAL MOTION IN A TUBE, AND USE THEREOF

[75] Inventors: David Freychet; Roben Loutaty, both of Le Havre, France

[73] Assignee: Compagnie de Raffinage et de Distribution Total France, Paris, France

[21] Appl. No.: 166,713

[22] Filed: Mar. 11, 1988

[30] Foreign Application Priority Data

Mar. 13, 1987 [FR] France ..... 87 03462

[51] Int. Cl.[4] ..... F28G 1/12

[52] U.S. Cl. ..... 165/94; 165/85; 165/109.1; 15/104.05

[58] Field of Search ..... 15/104.061, 104.05; 165/94, 85, 109.1

[56] References Cited

U.S. PATENT DOCUMENTS

| | | | |
|---|---|---|---|
| 4,174,750 | 11/1979 | Nichols | 165/94 |
| 4,564,066 | 1/1986 | Gorman | 165/158 |
| 4,583,585 | 4/1986 | Estienne et al. | 165/94 |
| 4,595,047 | 6/1986 | Estienne | 165/76 |
| 4,641,705 | 2/1987 | Gorman | 165/85 |
| 4,781,245 | 11/1988 | Freychet et al. | 165/94 |

FOREIGN PATENT DOCUMENTS

| | | |
|---|---|---|
| 0174254 | 8/1985 | European Pat. Off. . |
| 3327321 | 2/1985 | Fed. Rep. of Germany . |

*Primary Examiner*—Ira S. Lazarus
*Assistant Examiner*—Christopher Hayes
*Attorney, Agent, or Firm*—Curtis, Morris & Safford

[57] ABSTRACT

The invention relates to a device for maintaining in position one end of an element driven in rotation by a fluid circulating in a tube (12), the other end of said element being free, said device being of the type which comprises a part forming a bearing (1) and adapted to be rigidly attached to one end of the tube, and an element (4), mounted for rotation relative to the part forming a bearing (1) and adapted to be attached to one end of the movable element (13). In accordance with the invention, the part forming a bearing (1) is a one-piece part made of a rigid material that is capable of being elastically deformed, said one-piece part comprising at least two flanges (2) spaced apart by such a distance that they can be force-fitted into an open end of said tube (12) to bear elastically on its inner wall so as to rigidly join the part forming a bearing (1) to the tube.

14 Claims, 2 Drawing Sheets

DEVICE FOR MAINTAINING IN POSITION ONE END OF AN ELEMENT MOUNTED FOR ROTATIONAL MOTION IN A TUBE, AND USE THEREOF

The present invention relates to a device for maintaining in position one end of an element mounted for rotational motion in a tube. The invention further relates to the use of said device for the prevention of fouling and for the continuous cleaning of a pipe in which fluid circulates.

As is known, matter dissolved or suspended in liquid or gaseous fluids circulating in pipes has a tendency to deposit on the inner walls of these pipes. This is the case, for example, with aqueous solutions containing salts such as sodium carbonate, or with hydrocarbon mixtures containing inorganic and/or organic matter in suspension, and with hydrocarbons susceptible of forming coke by thermal cracking in contact with hot walls.

This phenomenon is generally encountered in the tubes of heat exchanges, whose efficiency falls off very rapidly unless their fouling is prevented or limited. This is true especially of preheat exchangers used in atmospheric or vacuum distillation in the petroleum industry.

It is possible, of course, to clean these tubes periodically, but this is a time-consuming and costly operation since it entails the shutdown of the production units, at least partial disassembly of the exchangers, and their reassembly after cleaning.

This is why it is generally preferred to prevent the fouling of these tubes by disposing in their interior a movable element in helicoidal form, for example, which is driven in rotation by the fluid circulating in the tube and which provides for the cleaning and/or prevention of fouling of the tube, whether the element does or does not come into contact with the inner wall of the tube. (See, for example, U.S. Pat. Nos. 4,174,750 and 3,648,754, British patent No. 347,904, and French patent application No. 2,569,829.)

However, maintaining movable elements in position in the interior of tubes poses certain problems since these elements must be freely driven in rotation by the fluid without appreciably affecting its circulation in the tubes, and without causing pronounced pressure drops.

The present invention seeks to propose a device for maintaining in position one end of an element mounted for rotational motion within a tube that satisfies the foregoing conditions and limits the fouling of heat exchangers in order to improve heat transfer.

The invention further seeks to propose an anchoring device of this type that can be produced at low cost and can be readily mounted in a tube provided with a rotatable element without requiring the use of tools or accessory means such as screws and pins.

The invention also seeks to propose a device of this type which can be attached simultaneously to the upstream end of a tube provided with a rotatable element and to the upstream end of that element.

Finally, the invention seeks to propose a device of this type that can be readily adapted to tubes of different diameters.

To this end, the invention has as an embodiment a device for maintaining in position one end of an element driven in rotation by a fluid circulating in a tube, the other end of that element being free, this device being of the type comprising a part forming a bearing and adapted to be rigidly attached to one end of the tube, and an element mounted for rotation relative to said part forming a bearing and adapted to be attached to one end of the movable element, said device being characterized in that the part forming a bearing is a one-piece part made of a rigid material that is capable of being elastically deformed, said one-piece part comprising at least two flanges spaced apart by such a distance that they can be force-fitted into an open end of the tube to bear elastically on its inner wall so as to rigidly join the part forming a bearing to the tube.

This can be accomplished advantageously by shaping an initially flat part. Thus, in its simplest embodiment, the part forms a frame which functions as a bearing or supports a bearing and has substantially the shape of a U with two flanges diverging from the central portion or base of the U. This part may be formed by bending a simple metal strip.

While the resulting pressure drops will then be greater, the part forming a bearing may, of course, also comprise three or four or even more flanges adjoining the same central portion and disposed uniformly relative thereto. In that case, the part forming a bearing may be produced by bending a flat part in the shape of a star with three or four or more points.

The flanges of the part forming a bearing generally are in the form of strips but may also have the shape of rods.

The flanges of the part forming a bearing may be inserted directly in the opening of a tube by bringing them together and then letting them spread apart by elasticity so that they will bear on the inner wall of the tube, to which they are thus attached. These flanges may be advantageously extended at one of their ends by a stud of reduced cross-sectional dimensions, which alone is inserted in the tube while the transverse edges of the ends of these flanges on both sides of the stud are seated on the rim of the corresponding end of the tube, thus fixing said part in position and thereby preventing its being dragged into the tube.

It will be appreciated that in the case of narrow flanges (of a width of less than 4 mm, for example), studs which are perpendicular to the general direction of the flanges should be substituted for the studs described above.

Conversely, since the flanges of the part forming a bearing diverge from the central portion, the latter may be force-fitted into the open end of the tube, the free ends of the flanges then being directed toward the opening of the tube.

The device in accordance with the invention thus permits the user to adapt it to the local conditions of the tubes to be provided with movable elements.

To impart rigidity to the bearing after the flanges have been bent out of a flat part, at least one notch may be advantageously formed in the flat part at the bending line of each of its flanges, in the general direction of the later, on either side of the bending line.

The element mounted rotatably relative to the part forming a bearing may conventionally consist of a pivot comprising a head and a shank inserted in an orifice in the central portion of the part forming a bearing. The end of the shank may be attached by any means known in the art to the movable element associated with the tube on which the part forming a bearing is mounted. For example, the free end of the shank may be bent to engage a ring-shaped end of the movable element, or vice versa. The free end of the shank may also be hollow to permit the corresponding end of the movable element to be set into it, the associated ends then being joined together by crimping or welding or by means of a screw fastener or the like.

To prevent rapid wear of the portions of the pivot head and of the bearing which are in contact with each other, these parts should be fabricated from low-friction materials. An antifriction washer may be interposed between these parts and advantageously crimped onto the bearing.

A principal advantage of the device of the invention thus is that it can be mounted at the end of a tube and attached to it without requiring the use of a tool or of any assembling means whatever.

A further advantage is that devices adapted to tubes of different diameters can be produced by appropriate bending of the flat part.

Of course, the use of the device in accordance with the invention for maintaining in position one end of a movable element disposed inside a tube and adapted to be driven in rotation by a fluid circulating therein for the purpose of preventing the fouling of the tube is a further object of the present invention.

This use of the invention will be found to be very advantageous in the case of heat-exchanger tubes. The ends of these tubes are usually set into openings in tube sheets which close the exchanger at each of its ends, and the tubes either project from these sheets by a few millimeters or are welded flush with these sheets. The use of the device of the invention is advantageous in either case.

The accompanying diagrammatic drawings show how the invention is carried out. In these drawings, FIG. 1 is a sectional view taken along the axis of a heat-exchanger tube which illustrates the use of the device in accordance with the invention for maintaining in positionthe upstream end of a movable element disposed within that tube and driven in rotation by the fluid which circulates therein;

Figure 2:
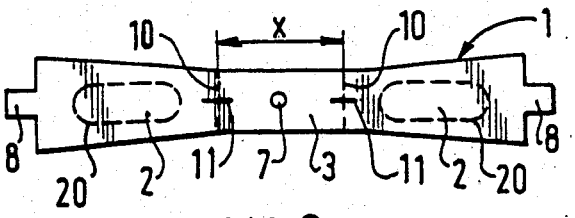
FIG. 2 is a top plan view of a flat part from which the part forming a bearing for said device may be produced by bending.

The device shown in the drawings comprises on the frame or one hand a substantially U-shaped part 1 forming a frame or bearing whose two flanges 2 diverge from the base 3, and, on the other hand, a pivot 4 comprising a head 5 and a shank 6 inserted in an orifice 7 in the base 3 of the bearing 1. In the assembly illustrated in FIG. 1, the shank 6 of the pivot is disposed in the interior of the bearing 1 between the two flanges 2.

The flanges 2 of the bearing are extended at their ends by studs 8. Shown in FIG. 3 at 8' in broken lines are studs which are perpendicular to the flanges 1 and 2 and may be substituted for the studs 8. Moreover, slots 20 which permit the pressure drops to be reduced are shown in FIG. 2 in broken lines.

Between the head 5 of the pivot 4 and the base 3 of the bearing 1, an antifriction washer 9 which may be loose, welded on or crimped on is interposed. Its surface in contact with the head 5 of the pivot may be flat or dished, depending on the profile of the head.

The bearing 1 is of one-piece construction and may be produced from a flat piece of metal in the form of a strip, shown in FIG. 2, by bending along two lines 10. To impart rigidity to it after bending, two notches 11 may be formed in the strip 1 at right angles to the bending lines. It will be noted that bearings adapted to tubes of different diameters can be produced from a given flat piece 1 by varying the spread x between the bending lines 10.

Figure 3:
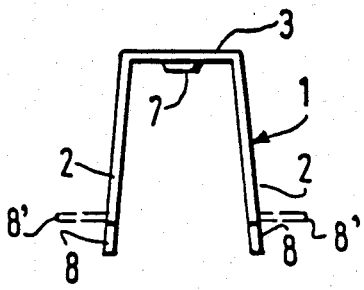
FIG. 3 is a side elevation of the part forming a bearing.
Figure 4:
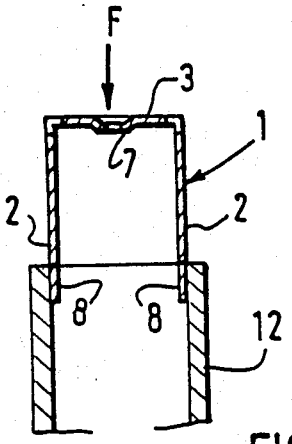
FIG. 4 is an axial sectional view illustrating the force fit in the opening of a tube of the part forming a bearing.
Figure 5:
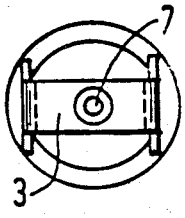
FIG. 5 is a view in the direction indicated by the arrow F in FIG. 4.

As is apparent from FIGS. 3 to 5, the bearing 1 can be mounted at the end of a tube 12 by bringing the flanges 2 together for insertion of the studs 8 in the tube 12, the transverse edges of the flanges 2 adjacent to the studs 8 then coming to be seated on the edge of the tube 12. When these flanges are then released, they tend to spread apart, due to their elasticity, and the studs 8 then come to bear on the inner wall of the tube 12, thereby securing the bearing 1 to the tube without there being any need for using a tool or any assembling means whatever.

Figure 1:
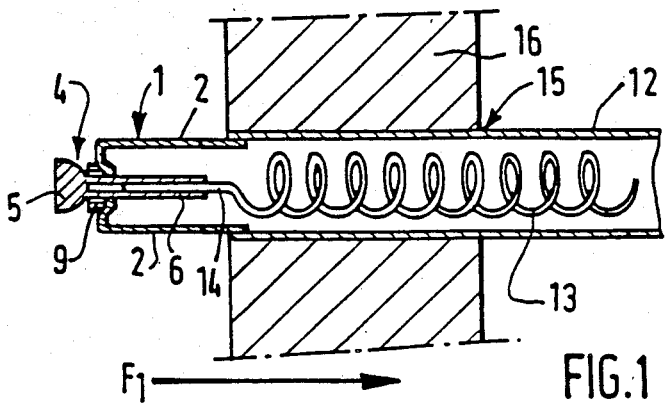

FIG. 1 illustrates the use of the device in accordance with the invention for maintaining in position one end of a helicoidal element 13, driven in rotation in a tube 12 of a heat exchanger by the fluid circulating in that tube in the direction indicated by the arrow $F_1$, for the purpose of preventing fouling of the tube and/or providing for its internal cleaning. In the case of the drawing, the shank 6 of the pivot 4 is hollow and the end of the helicoidal element 13 is inserted therein and crimped or welded.

The shank 6 and the end 14 of the movable element 13 may, of course, also be united by other conventional means, for example, by using a shank whose end, bent to form a hook, is inserted in a ring with which the end of the movable element 13 is provided, or, conversely, by bending the end of the movable element to form a hook and inserting the latter in a ring provided at the end of the shank of the pivot.

It will be noted that in FIG. 1 the tube 12 is set into an opening 15 in a tube sheet 16 of a heat exchanger and does not project from that sheet. This mounting method is applicable also to projecting tubes.

Figure 6:
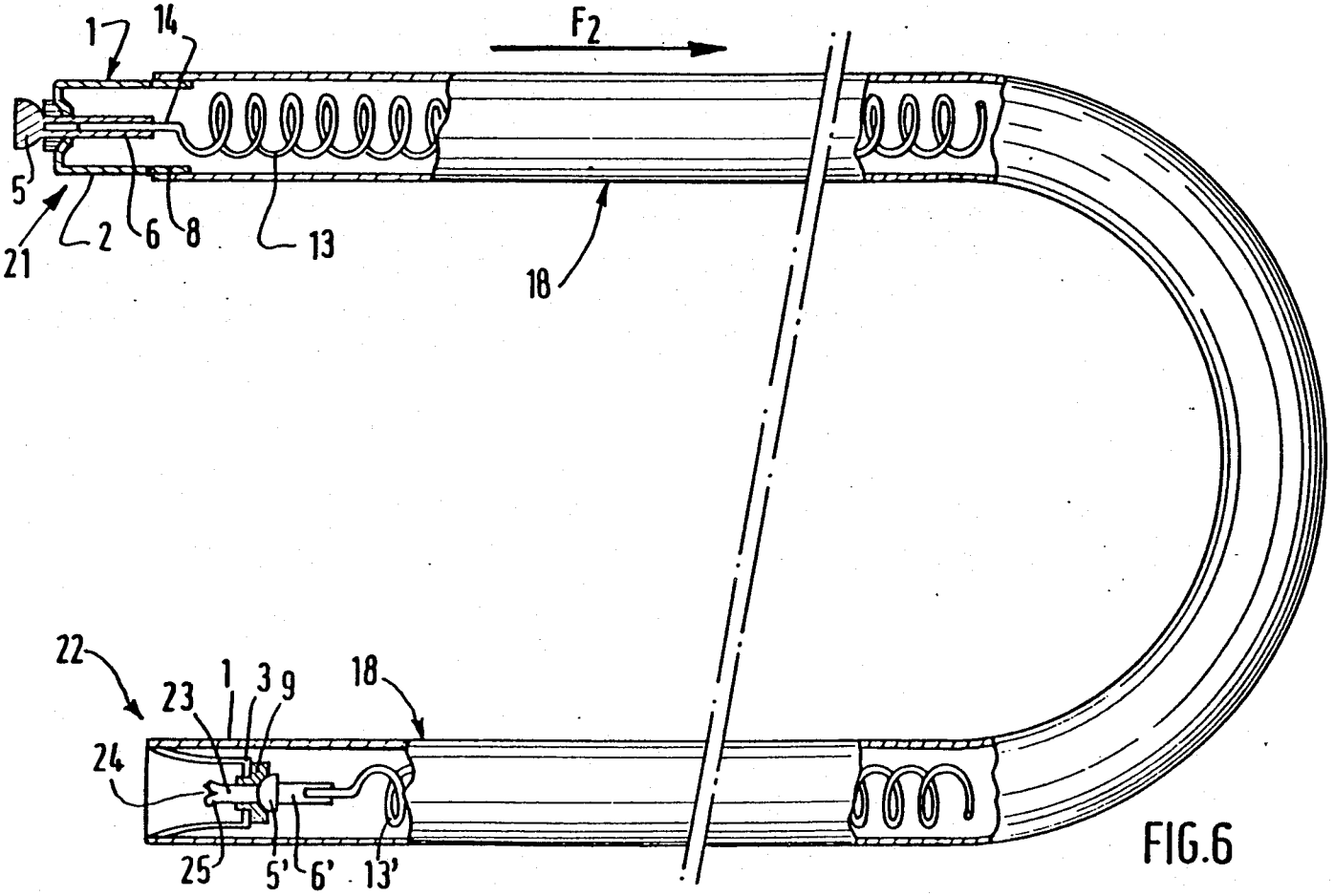
FIG. 6 illustrates two mounting modes of the device of the invention for maintaining in position the ends of two movable elements disposed inside a U tube and driven in rotation by the fluid which circulates therein.

FIG. 6 shows an embodiment of two dèvices in accordance with the invention in a tube 18 bent to form a U.

The fluid circulates in the direction indicated by the arrow $F_2$ from the upstream end 21 of the tube 18 to the downstream end 22 of the tube.

At the end 21 of the tube, the studs 8 in which the flanges 2 of the bearing 1 terminate are inserted in the tube in the manner described in connection with FIG. 1, and the head 5 of the pivot is on the outside of the bearing 1, as before. Conversely, at the other end 22 of the tube, the bearing 1 is set into the tube in the opposite direction, with the base 3 of the bearing located inside the tube, the U section of the bearing opening in the direction of the end 22 of the tube. Under the action of the circulating fluid, the two flanges, which preferably have a curved profile, bear on the inner wall of the tube 18 due to their elasticity.

The washer 9 is disposed in the same manner as before. The pivot, however, is of a different design. The head 5' of the pivot, located within the tube and connected through the shank 6' with another moving element 13', is extended by a shank 23 which traverses the base 3 of the bearing 1. In order that the pivot may be captive within the bearing, the end 24 of the shank 23 has first been cleft, for example, in such a way that upon assembly the two jaws 25 of the shank are spread apart to hold the pivot captive in the bearing. Thus, under the action of the fluid circulating in the tube, the head 5' is constantly in contact with the inner surface of the washer 9.

The device of the invention is of pronounced simplicity and readily mounted on the tubes without the use of any tool or assembling means. Moreover, a given flat part can be used to produce bearings adapted to tubes of different diameters.

We claim:

1. A device connectable to a tube for maintaining in position within said tube one end of a movable element adapted to be driven in rotation by a fluid flowing in said tube, another end of said movable element being free, said device comprising:

bearing means adapted to be shallowly inserted at an open end of said tube, and to be strongly secured to said tube, said bearing means being formed of a material which is elastically deformable and including at least one base in the form of a flat construction having a central part and two flanges, said flanges being disposed at each end of said base and extending on the same side of said base, in a slightly opened angle, such that said flanges are force fittable into said open end of said tube to be shallowly inserted in said tube and to bear elastically on the inner wall of said tube so as to be strongly secured to said tube; and connection means mounted for permitting a free rotation relative to said bearing means and adapted to be connected to said one end of said movable element;

said connection means being formed as a pivot including a head portion and a shank portion, said pivot being disposed in an orifice located in the central part of said bearing means.

2. A device according to claim 1, wherein said bearing means is produced from a one-piece flat construction of rigid material which is elastically deformable by bending said flanges along respective bending lines.

3. A device according to claim 2, wherein said flat construction includes notches extending at right angles across respective ones of said bending lines.

4. A device according to claim 1, wherein said bearing means is substantially U-shaped and includes a base and two flanges roughly perpendicular to said base, or able to be disposed in a perpendicular position by applying a force on said flanges.

5. A device according to claim 1, wherein each of said flanges terminates in a free edge and has a stud extending from said free edge, said studs being able to be inserted in said tube, wherein said studs engage said inner wall of said tube, and remaining portions of said free edges engage an edge of said tube surrounding said open end when said device is in position.

6. A device according to claim 1, wherein said shank portion is hollow for rigidly receiving said one end of said movable element therein.

7. A device according to claim 6, wherein said movable element includes a ring-shaped portion at said one end and said shank portion terminates at a bent end for hookedly engaging said ring-shaped portion.

8. A device according to claim 6, wherein said shank portion terminates in a ring-shaped portion and said movable element includes a bent end for hookedly engaging said ring-shaped portion.

9. A device according to claim 6, wherein said bearing means further includes an antifriction washer interposed between said head portion and said central portion.

10. A device according to claim 6, wherein said shank portion has an outer configuration which maintains said shank portion in said orifice and wherein said movable element is connected to said head portion, whereby said device may be placed in postion in said tube at said open end with said movable element upstream of said bearing means.

11. A device according to claim 6, wherein said movable element is connected to said shank portion, whereby said device may be placed in position in said tube with said movable element downstream of said bearing means.

12. Apparatus for continuously cleaning a tube, comprising:

a tube adapted to have a fluid flowing therein;

a movable element positioned within said tube and adapted to be driven in rotation by fluid flowing in said tube; and a device for maintaining said movable element in position within said tube, one end of said movable element being connected to said device and another end being free;

said device including bearing means adapted to be shallowly inserted at an open end of said tube, and to be strongly secured to said tube, said bearing means being formed of a material which is elastically deformable and including at least one base in the form of a flat construction having a central part and two flanges, said flanges being disposed at each end of said base and extending on the same side of said base, in a slightly opened angle, such that said flanges are force fittable into said open end of said tube to be shallowly inserted in said tube and to bear elastically on the inner wall of said tube so as to be strongly secured to said tube; and connection means mounted for permitting a free rotation relative to said bearing means and adapted to be connected to said one end of said movable element, said connection means being formed as a pivot including a head portion and a shank portion, said pivot being disposed in an orifice located in the central part of said bearing means.

13. Apparatus according to claim 12, wherein said bearing means is substantially U-shaped and includes a base and two flanges roughly perpendicular to said base, or able to be disposed in a perpendicular position by applying a force on said flanges.

14. Apparatus according to claim 13, wherein each of said flanges terminates in a free edge and has a stud extending from said free edge, said studs extending inside said tube and engaging said inner wall, and remaining portions of said free edges engaging an edge of said tube surrounding said open end.

* * * * *